US007758210B2

(12) United States Patent
Peck

(10) Patent No.: US 7,758,210 B2
(45) **Date of Patent: *Jul. 20, 2010**

(54) BEACON LIGHT WITH LIGHT-TRANSMITTING ELEMENT AND LIGHT-EMITTING DIODES

(75) Inventor: John Patrick Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 125 days.

This patent is subject to a terminal disclaimer.

(21) Appl. No.: 11/437,167

(22) Filed: May 19, 2006

(65) Prior Publication Data

US 2006/0209541 A1 Sep. 21, 2006

Related U.S. Application Data

(63) Continuation-in-part of application No. 11/300,770, filed on Dec. 15, 2005, now Pat. No. 7,568,821, which is a continuation-in-part of application No. 11/069,989, filed on Mar. 3, 2005, now Pat. No. 7,160,004.

(51) Int. Cl.
*F21V 7/00* (2006.01)

(52) U.S. Cl. ..... 362/247; 362/227; 362/242; 362/335; 362/498; 362/540

(58) Field of Classification Search ..... 362/247, 362/227, 235, 242–244, 236, 249, 335–341, 362/498, 499, 540, 542, 543, 545, 555, 612, 362/800, 234, 252, 297, 346, 347, 493; 340/815.45
See application file for complete search history.

(56) References Cited

U.S. PATENT DOCUMENTS 5,642,933 A 7/1997 Hitora
5,769,532 A 6/1998 Sasaki
5,929,788 A 7/1999 Vukosic
6,183,100 B1 2/2001 Suckow et al.
6,425,678 B1 7/2002 Verdes et al.
6,464,373 B1 10/2002 Petrick
6,533,446 B2 3/2003 Chen et al.
6,637,921 B2 * 10/2003 Coushaine ..... 362/517
6,717,526 B2 * 4/2004 Martineau et al. ..... 340/815.45
6,762,695 B1 7/2004 Eslambolchi et al.

(Continued)

OTHER PUBLICATIONS

Partial European Search Report for EP Application EP 06110676, copy consists of 4 unnumbered pages.

(Continued)

*Primary Examiner*—Jong-Suk (James) Lee
*Assistant Examiner*—Mark Tsidulko

(57) ABSTRACT

One embodiment of a light-emitting diode (LED) optic comprises a light-transmitting element having a plurality of segments, each segment associated with an optical axis and comprising a linearly projected cross-section. For each segment of the light-transmitting element, the LED optic comprises at least one LED positioned such that a central light-emitting axis of the at least one LED is angled at about 0° relative to the optical axis associated with that segment. In one embodiment, the about 0° has a tolerance of ±10°. Each segment of the light-transmitting element comprises a light-entering surface, a light-exiting surface and a light-reflecting surface. In one embodiment, for each segment the at least one LED comprises a plurality of LEDs.

21 Claims, 15 Drawing Sheets

U.S. PATENT DOCUMENTS

| | | | |
|---|---|---|---|
| 6,867,710 | B2 | 3/2005 | Wobben |
| 6,948,830 | B1 | 9/2005 | Petrick |
| 7,568,821 | B2 | 8/2009 | Peck et al. |
| 2003/0193807 | A1 | 10/2003 | Rizkin |
| 2004/0057234 | A1 | 3/2004 | Mohacsi |
| 2004/0085764 | A1 | 5/2004 | Martin et al. |
| 2005/0128744 | A1 | 6/2005 | You et al. |
| 2005/0156531 | A1 | 7/2005 | Young |
| 2006/0012990 | A1 | 1/2006 | Walser et al. |
| 2006/0176702 | A1 * | 8/2006 | Shen et al. ..... 362/311 |

OTHER PUBLICATIONS

Extended European Search Report for Application No. EP06110676, Jun. 20, 2007, copy consists of 11 unnumbered pages.
PCT Search Report and Written Opinion for PCT/US07/68967, Sep. 15, 2008, copy consists of 13 pages.

* cited by examiner

BEACON LIGHT WITH LIGHT-TRANSMITTING ELEMENT AND LIGHT-EMITTING DIODES

CROSS REFERENCE TO RELATED APPLICATION

This application is a continuation-in-part of U.S. patent application Ser. No. 11/300,770, filed on Dec. 15, 2005, which is hereby incorporated by reference in its entirety, and which is a continuation-in-part of U.S. patent application Ser. No. 11/069,989, filed on Mar. 3, 2005, now U.S. Pat. No. 7,160,004 which is hereby incorporated by reference in its entirety.

BACKGROUND OF THE INVENTION

1. Field of the Invention

The present invention generally relates to a light source, and more particularly to a light-emitting diode (LED)-based beacon light.

2. Description of the Related Art

A beacon light such as, for example, an aircraft obstruction light, can be used to mark an obstacle that may provide a hazard to aircraft navigation. Beacon lights are typically used on buildings, towers, and other structures taller than about 150 feet. Previous beacon lights generally exhibit relatively poor energy efficiency, which can prohibit the use of solar panels to power the beacon light. Previous beacon lights may also contribute to light pollution, i.e., direct light at angles undesirably above and below a specified plane. Previous beacon lights may also be too large and heavy for climbers to carry and therefore may require additional machinery or manpower to be hoisted into position.

SUMMARY OF THE INVENTION

Various deficiencies of the prior art are addressed by the present invention, one embodiment of which is a beacon light having a light-emitting diode (LED) optic. One embodiment of the light-emitting diode (LED) optic comprises a light-transmitting element having a plurality of segments, each segment associated with an optical axis and comprising a linearly projected cross-section. For each segment of the light-transmitting element, the LED optic comprises a plurality of LEDs positioned such that a central light-emitting axis of each LED is angled at about 0° relative to the optical axis associated with that segment. In one embodiment, the about 0° has a tolerance of ±10°. Each segment of the light-transmitting element comprises a light-entering surface, a light-exiting surface and a light-reflecting surface.

One embodiment of a method comprises arranging a plurality of segments of a light-transmitting element relative to each other, each segment associated with an optical axis and comprising a linearly projected cross-section. For each segment of the light-transmitting element, the method comprises positioning a plurality of LEDs such that a central light-emitting axis of each LED is angled at about 0° relative to the optical axis associated with that segment. In one embodiment, the about 0° has a tolerance of ±10°. The method also comprises transmitting light from the plurality of LEDs. The method further comprises providing a light-entering surface, a light-exiting surface and a light-reflecting surface of each segment of the light-transmitting element.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

Figure 1:
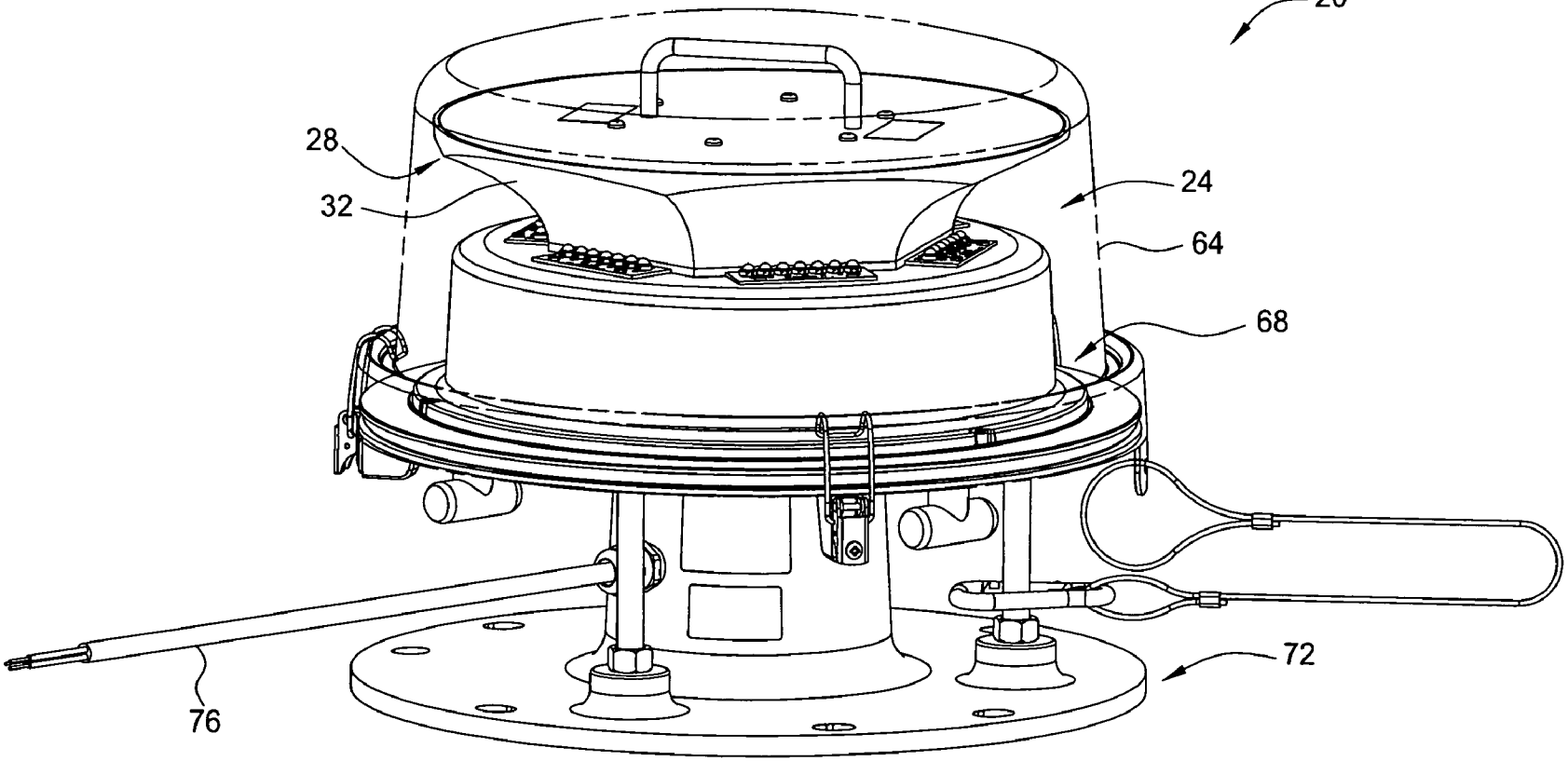
FIG. 1 depicts a perspective view of an embodiment of the beacon light according to the present invention.

FIG. 1 depicts a perspective view of a beacon light 20 according to one embodiment of the present invention. The beacon light 20 comprises an LED reflector optic 24. In one embodiment, the beacon light 20 also comprises a shield 64, a pedestal 68, a base 72, an electrical connection 76 to the beacon light 20, and circuitry (not shown) to drive the beacon light 20. In one embodiment, the drive circuitry (not shown) is capable of strobing the LED reflector optic 24. The pedestal 68 supports the LED reflector optic 24, and the base 72 provides a means for attaching the beacon light 20 to a structure.

Figure 2:
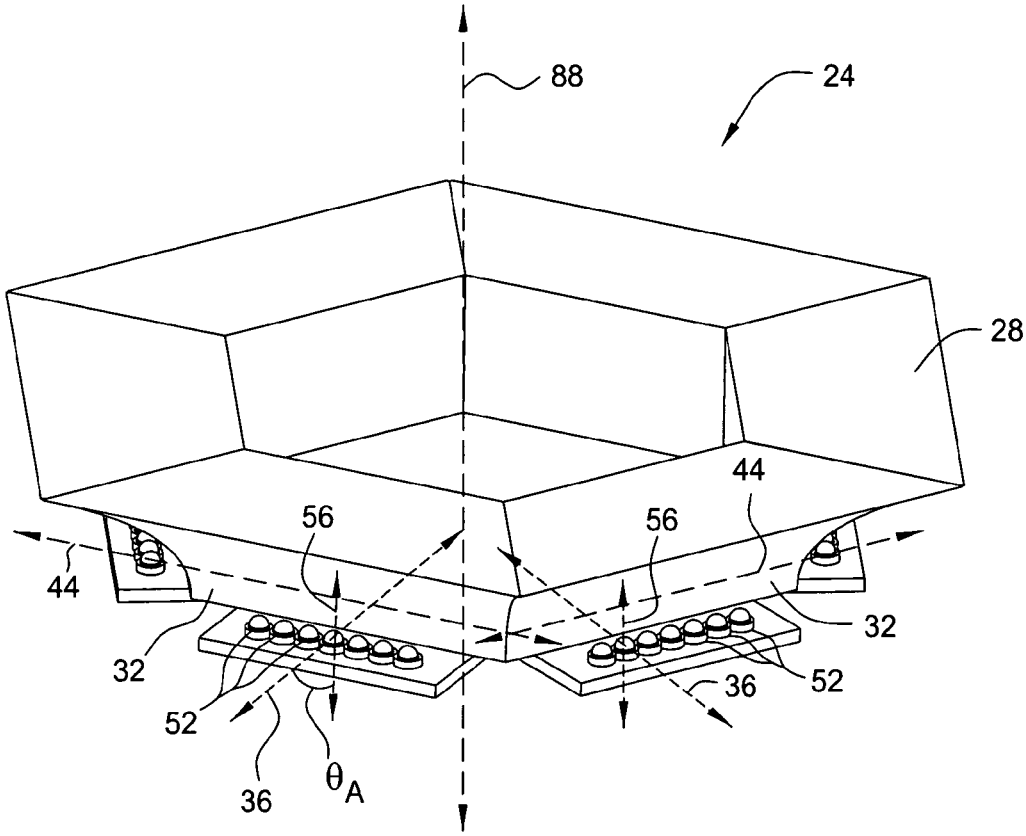
FIG. 2 depicts a perspective view of an embodiment of the LED reflector optic of the beacon light depicted in FIG. 1.

FIG. 2 depicts a perspective view of an embodiment of the LED reflector optic 24 according to the present invention. In one embodiment, the LED reflector optic 24 comprises a reflector 28 having a plurality of reflecting surfaces 32, i.e., a segmented reflector 28.

Figure 8:
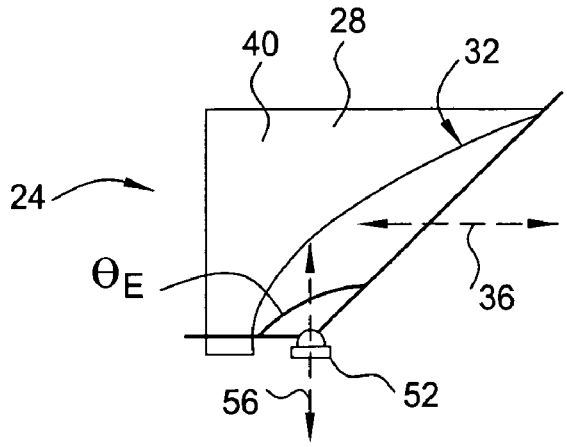
FIG. 8 depicts a partial sectional side view of an embodiment of the LED reflector optic depicted in FIG. 2.

Each reflecting surface 32 comprises a cross-section 40 (as depicted in FIG. 8) which is projected along an associated linear extrusion axis 44. In one embodiment, the linearly projected cross-section 40 comprises a conic section. A conic section provides an advantageous reflected light intensity distribution. In one embodiment, the cross-section 40 of the reflecting surface 32 comprises at least one of: a conic or a substantially conic shape. In one embodiment, the conic shape comprises at least one of: a hyperbola, a parabola, an ellipse, a circle, or a modified conic shape.

Each reflecting surface 32 has an associated optical axis 36. In one embodiment, each reflecting surface 32 reflects a beam of light having an angular distribution horizontally symmetric to the associated optical axis 36, i.e. symmetric about the associated optical axis 36 in directions along the extrusion axis 44.

For each reflecting surface 32, the LED reflector optic 24 comprises at least one associated LED 52. The LED 52 has a central light-emitting axis 56, and typically emits light in a hemisphere centered and concentrated about the central light-emitting axis 56. The LED 52 is positioned relative to the associated reflecting surface 32 such that the central light-emitting axis 56 of the LED 52 is angled at a predetermined angle $\theta_A$ relative to the optical axis 36 associated with the reflecting surface 32. In a preferred embodiment, $\theta_A$ has a value of about 90°. In one embodiment, the about 90° has a tolerance of ±30°, i.e., from 60° to 120°.

Figure 3:
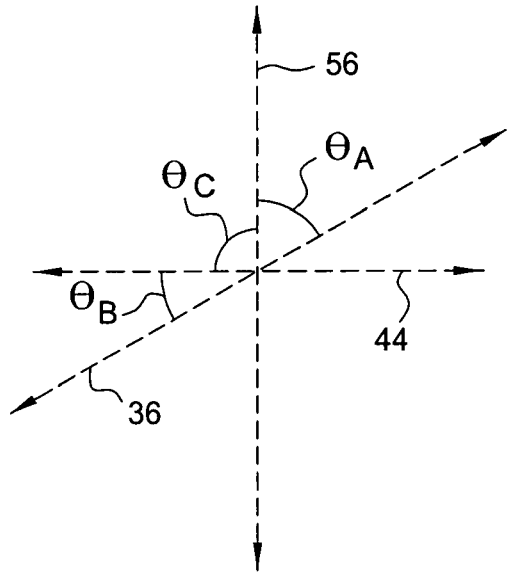
FIG. 3 depicts a perspective view of an embodiment of the angular relationship between the optical axis associated with the reflecting surface of the LED reflector optic depicted in FIG. 2; the central light emitting axis of the LED of the LED reflector optic, and the extrusion axis of the reflecting surface.

In one embodiment, for a specific reflecting surface 32 and associated LED 52, the central light-emitting axis 56 of the LED 52, the optical axis 36 associated with the reflecting surface 32, and the extrusion axis 44 of the reflecting surface 32 form orthogonal axes of a 3-axes linear coordinate system. Namely, the central light-emitting axis 56, the optical axis 36, and the extrusion axis 44 are mutually perpendicular. FIG. 3 depicts a representation of the mutually perpendicular relationship between the central light-emitting axis 56, the optical axis 36, and the extrusion axis 44. In FIG. 2, $\theta_B$ is the angle between the optical axis 36 and the extrusion axis 44, and $\theta_C$ is the angle between the central light emitting axis 56 and the extrusion axis 44. In one embodiment, the mutually perpendicular relationship between the central light-emitting axis 56, the optical axis 36, and the extrusion axis 44 is approximate. For example, each of the central light-emitting axis 56, the optical axis 36, and the extrusion axis 44 can be angled at 90° from each of the other two axes, with a tolerance, in one embodiment, of ±30°.

In one embodiment, for each reflecting surface 32, the LED reflector optic 24 comprises a plurality of associated LEDs 52. In one embodiment, the plurality of associated LEDs 52 are arranged along a line, as depicted in FIG. 2, parallel to the extrusion axis 44 of the reflecting surface 32. In one embodiment, the plurality of associated LEDs 52 are staggered about a line. For example, in one embodiment, the plurality of associated LEDs 52 are staggered about a line, with the staggering comprising offsetting the LEDs 52 from the line by a predetermined distance in alternating directions perpendicular to the line. Also, in one embodiment, the LED 52, or the plurality of LEDs 52, are positioned at the focal distance of the reflecting surface 32.

Figure 4:
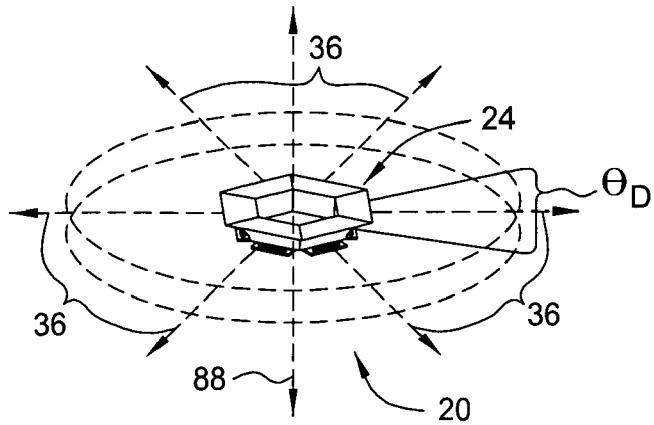
FIG. 4 depicts a partial perspective view of an embodiment of the beacon light depicted in FIG. 1.

FIG. 4 depicts a partial perspective view of an embodiment of the beacon light 20 in which the beacon light 20 emits light outward over a 360° angular distribution about a central axis 88 of the reflector 28 of the LED reflector optic 24. Such a 360° angular distribution of reflected light may be a requirement for the beacon light 20 to provide obstruction warning in all directions.

The light emitted from the beacon light 20 has a predetermined beam spread $\theta_D$, as depicted in FIG. 4. The beam spread $\theta_D$ is the angle, vertically perpendicular to the optical axes 36 of the reflecting surfaces 32, over which the intensity of the emitted light is greater than 50% of the peak intensity of the emitted light. In a preferred embodiment, the beacon light 20 has a beam spread $\theta_D$ of less than 3°. In another embodiment, the beacon light 20 has a beam spread $\theta_D$ of less than 10°.

Figure 5:
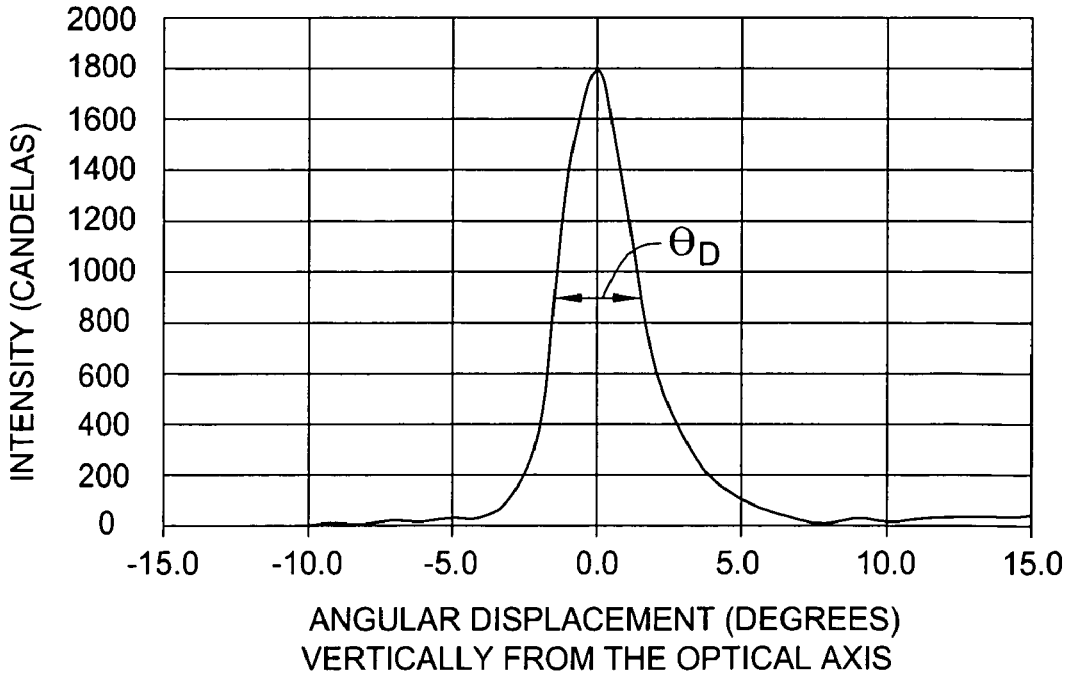
FIG. 5 is a graph depicting a representation of the intensity, versus angular displacement vertically from the optical axis, of light emitted from an embodiment of the beacon light depicted in FIG. 1.

FIG. 5 is a graph depicting a representation of the light intensity, versus angular displacement vertically perpendicular to the optical axes 36, emitted from an embodiment of the beacon light 20. FIG. 5 shows the beam spread $\theta_D$ for this embodiment is approximately 3°, i.e., about 1.5° on either side of a plane containing the optical axes 36.

Figure 6:
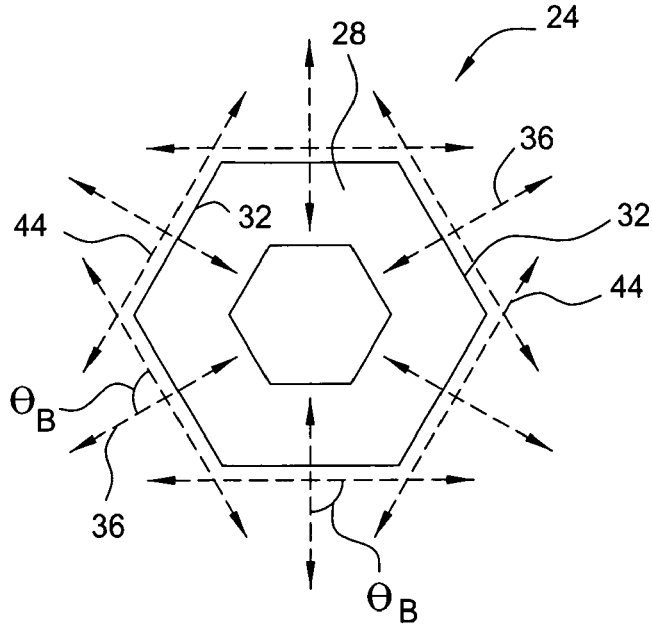
FIG. 6 depicts a sectional top view of an embodiment of the reflector of the LED reflector optic depicted in FIG. 2.

The plurality of reflecting surfaces 32 of the reflector 28 are arranged so that each of the associated extrusion axes 44 is angled relative to the extrusion axis 44 of another reflecting surface 32. In one embodiment, the plurality of extrusion axes 44 occupy a single plane and intersect each other to outline a polygon. Namely, a top view cross-section of the reflector comprises a perimeter which is a polygon. FIG. 6 depicts a sectional top view of an embodiment of the reflector 28, showing the plurality of associated extrusion axes 44 intersecting each other to form a hexagon. Such an embodiment achieves the 360° angular distribution, relative to the central axis 88 of the reflector 28, of light emitted from the LED reflector optic 24. Each reflecting surface 32 reflects light in the direction of the optical axis 36 associated with that reflecting surface 32, and through an angular distribution horizontally symmetric to and centered to the optical axis 36.

Although FIG. 6 depicts a polygon embodiment of the reflector 28 having six reflecting surfaces 32, in another polygon embodiment the reflector 28 has at least three reflecting surfaces 32.

Figure 7:
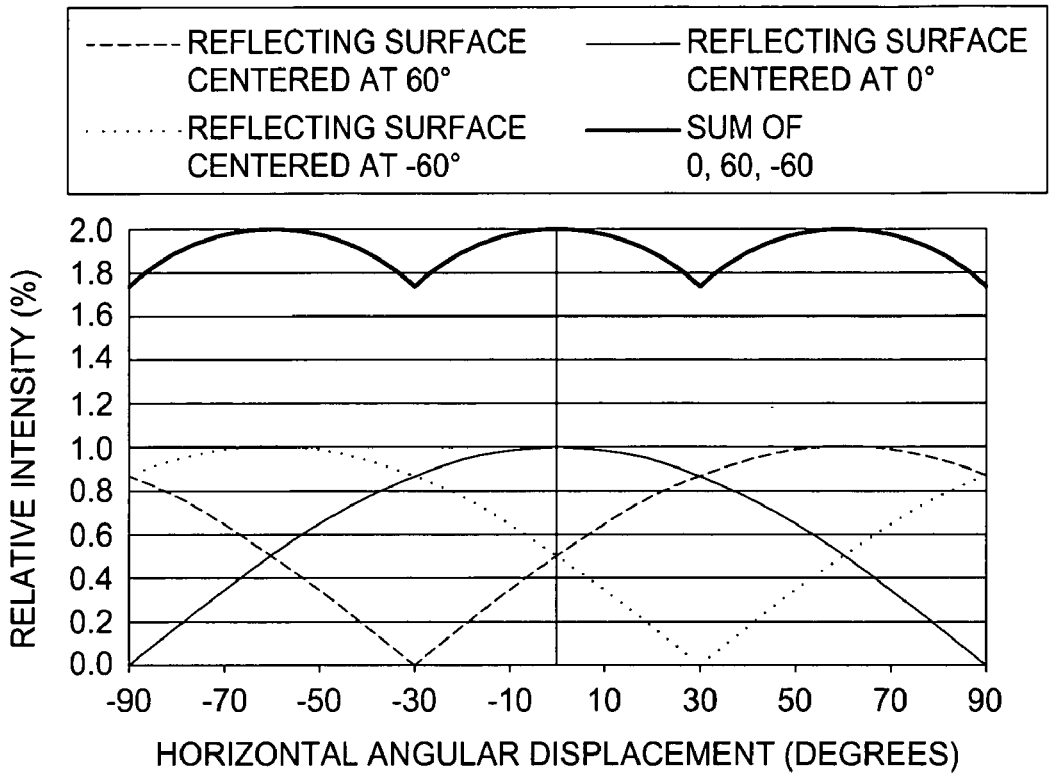
FIG. 7 is a graph depicting a representation of the relative intensity, versus angular displacement, of light reflected from three different adjacent reflecting surfaces, and the sum thereof, of an embodiment of the LED reflector optic depicted in FIG. 2.

In one embodiment, each horizontal angular distribution of reflected light associated with a specific reflecting surface 32 overlaps the horizontal angular distribution of reflected light associated with an adjacent reflecting surface 32. FIG. 7 is a graph depicting a representation of the relative intensity, versus horizontal angular displacement, of light reflected from three different adjacent reflecting surfaces 32, and the sum thereof. The thick solid line of FIG. 7 represents the overall intensity of light emitted from the LED reflector optic 24, including light reflected from all of the three adjacent reflecting surfaces 32. The thin solid line represents the intensity of light reflected from the reflecting surface 32 associated with the optical axis 36 about which the angular displacement of FIG. 7 is centered, i.e. the reflecting surface 32 having the optical axis at 0° as shown in FIG. 7. The dotted and dashed lines of FIG. 7 represent the intensity of light reflected from the two reflecting surfaces 32 adjacent and connected to the first reflecting surface 32. FIG. 7 shows that the light reflected from each reflecting surfaces 32 overlaps the light reflected from adjacent reflecting surfaces 32 to form an overall reflection of light from the reflector 28 which has a more uniform intensity profile, versus angular displacement, than the individual intensity profiles of light reflected from the individual reflecting surfaces 32.

In one embodiment, the intersection of the plurality of extrusion axes 44 does not necessarily outline a polygon. In one embodiment, light emitted from the LED reflector optic 24 does not have a 360° angular distribution relative to the central axis 88 of the reflector 28. Such an embodiment may instead achieve, for example, a 180° angular distribution.

In one embodiment, the plurality of reflecting surfaces 32 of the segmented reflector 28 are connected together.

The utilization of light emitted by the LED 52 by one embodiment of the LED reflector optic 24 provides an advantage of the present invention. To further understand this advantage, the utilization of light by one embodiment of the LED reflector optic 24 can be compared to the utilization of light in an alternative relative positioning of the LED 52 and the reflecting surface 32.

FIG. 8 depicts a partial sectional side view of an embodiment of the LED reflector optic 24. In the embodiment shown in FIG. 8, the reflecting surface 32 has a conic cross-section, and the central light-emitting axis 56 of the LED 52 is in the same plane as the shown cross-section. FIG. 8 also shows the angle $\theta_E$ over which light, emitted from the LED 52, is reflected by the reflecting surface 32.

Figure 9:
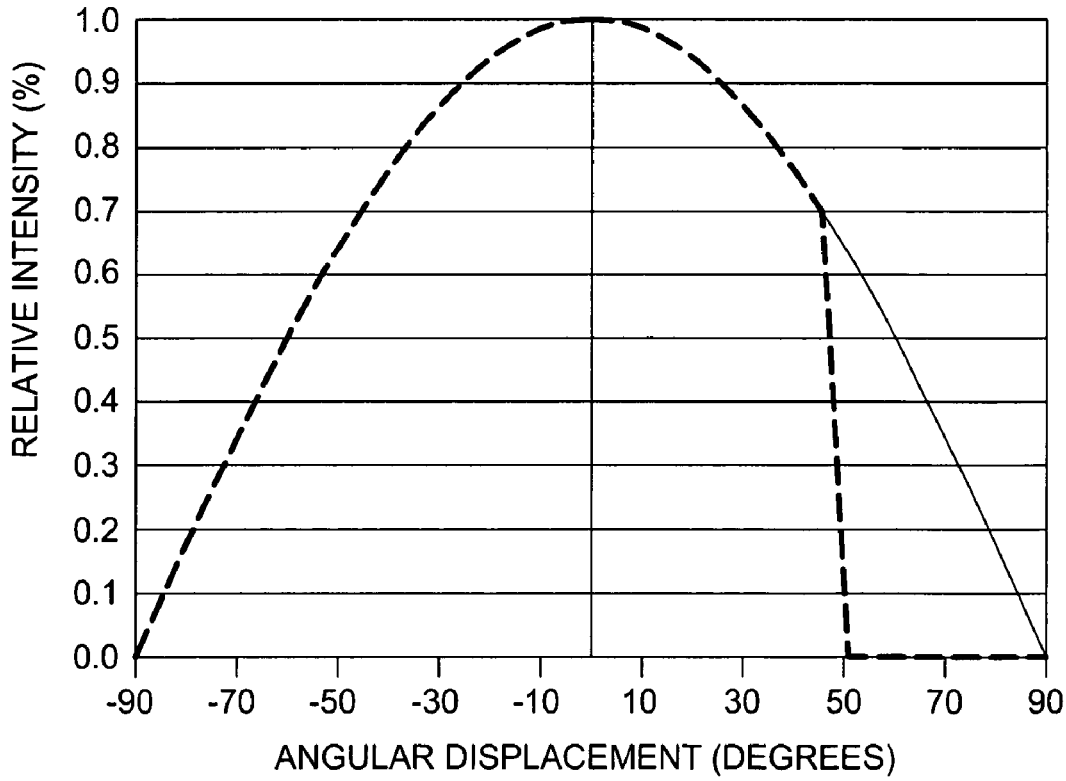
FIG. 9 is a graph depicting a representation of relative light intensity, versus angular displacement, for light typically emitted from the LED, and for light reflected by the embodiment of the LED reflector optic depicted in FIG. 8.

FIG. 9 is a graph depicting a representation of the relative intensity of light, versus angular displacement in the plane of FIG. 8, for light typically emitted by the LED 52, and for light reflected by the reflecting surface 32 of the LED reflector optic 24 shown in FIG. 8. The solid line of FIG. 9 represents the light intensity distribution typically emitted by the LED 52, i.e., without the reflecting surface 32 present, versus angular displacement relative to the central light emitting axis 56. The light intensity distribution emitted by the LED 52 is typically lambertian. However, other light intensity distributions may also benefit from the present invention. The light intensity distribution emitted by the LED 52 includes light over about 180°, i.e., about 90° on either side of the central light-emitting axis 56. The dotted line of FIG. 9 represents the portion of the light intensity distribution emitted by the LED 52 which is reflected by the reflecting surface 32 positioned relative to the LED 52 as shown in FIG. 8. The dotted line shows that light over the angle $\theta_E$, i.e., about 135°, of the angular distribution of the LED emission is reflected by the reflecting surface 32. The angle $\theta_E$ includes about 90° on one side of the central light-emitting axis 56 and about 45° on the other side of the central light-emitting axis 56. The portion of the LED emission which is reflected by the reflecting surface 32, i.e. the portion of the LED emission within angle $\theta_E$, is utilized light. The portion of the LED emission which is not reflected by the reflecting surface 32, i.e. the portion of the LED emission outside the angle $\theta_E$, is unutilized light.

Figure 10:
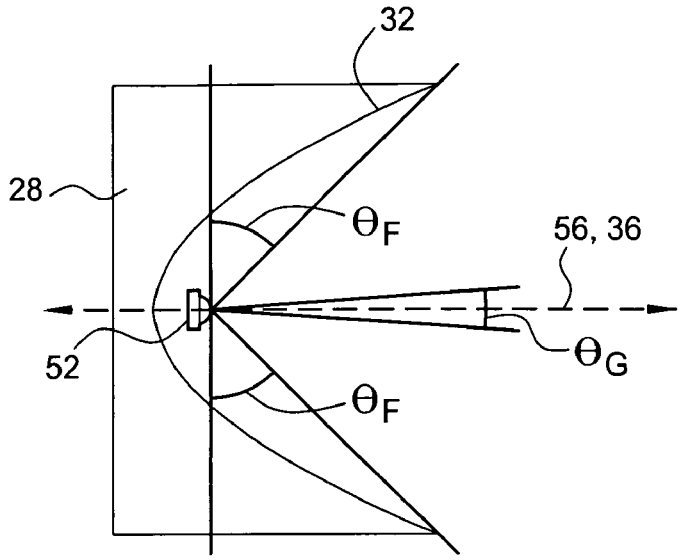
FIG. 10 depicts an embodiment of an alternative arrangement of the LED and reflecting surface.

FIG. 10 depicts an embodiment of an alternative relative positioning of the LED 52 and the reflecting surface 32. In this alternative arrangement, the central light-emitting axis 56 of the LED 52 is arranged to be parallel to the optical axis 36 of the reflecting surface 32.

Figure 11:
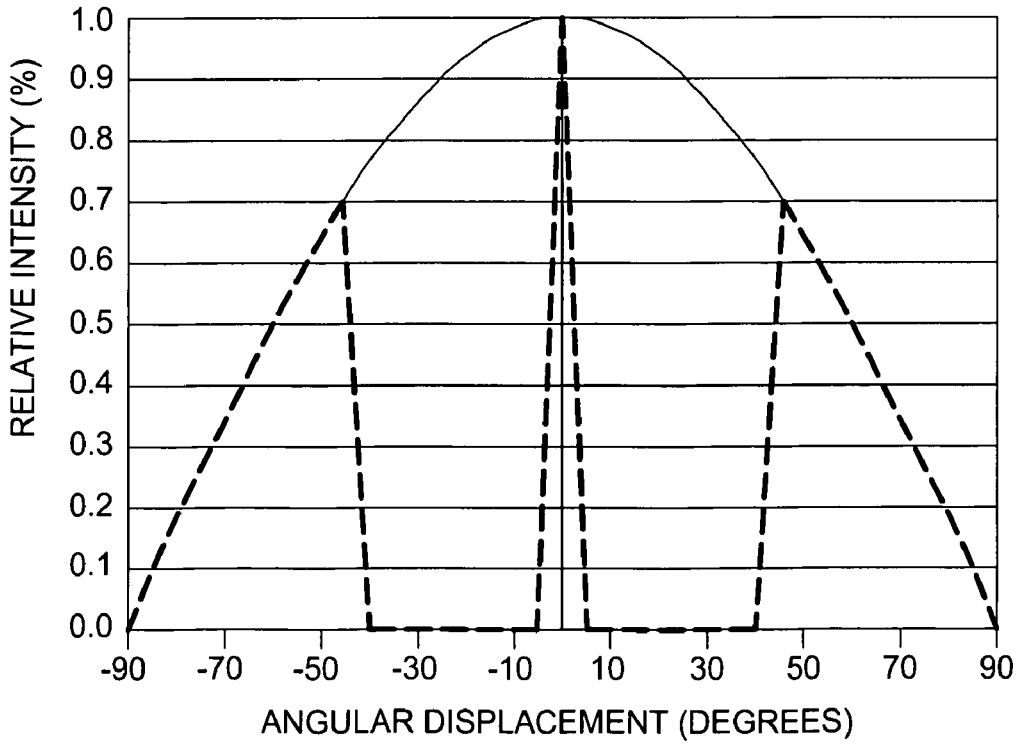
FIG. 11 is a graph depicting a representation of relative light intensity, versus angular displacement, for light typically emitted from the LED, and for light emitted from the embodiment of the alternative arrangement of the LED and reflecting surface depicted in FIG. 10.

FIG. 11 is a graph depicting a representation of the relative intensity of light, versus angular displacement in the plane of FIG. 10, for the typical light emission by the LED 52, and for light emitted by the alternative arrangement of the LED 52 and the reflecting surface 32 depicted in FIG. 10. The solid line of FIG. 11 represents the typical light intensity distribution emitted by the LED 52 without the presence of the reflecting surface 32. The dotted line of FIG. 11 represents the portion of the typical LED light intensity distribution which is utilized by the arrangement depicted in FIG. 10. The portion of light utilized comprises a first portion over an angle $\theta_G$, centered about the central light-emitting axis 56 and not reflected by the reflecting surface 32, and a second portion over an angle $\theta_F$ on either side of the central light-emitting axis 56, i.e., from 90° to $90°-\theta_F$, and from −90° to $-90°+\theta_F$, wherein $\theta_F$ is about 45°. The first portion is utilized because if falls within the desired beam spread $\theta_D$ of the beacon light 20, and in one embodiment angle $\theta_G$ equals the beam spread $\theta_D$. The second portion is utilized because it is reflected by the reflecting surface 32 to also fall within the desired beam spread $\theta_D$ of the beacon light 20. An unutilized portion of the typical light intensity distribution which is over angles, relative to the central light emitting axis 56, from 0.5 $\theta_G$ to $90°-\theta_F$, and from $-0.5\ \theta_G$ to $-90°+\theta_F$, is not utilized because it is not reflected by the reflecting surface 32. The unutilized portion of the typical light intensity distribution emitted by the LED 52 from $-0.5\ \theta_G$ to $-90°+\theta_F$ is undesirable and may be considered to be light pollution because it typically points downward towards the ground from, for example, a relatively high position.

Thus, FIG. 11 shows that the alternative relative positioning of the LED 52 and the reflecting surface 32 depicted in FIG. 10 does not utilize the majority of the high intensity central portion of the light intensity distribution typically emitted by the LED 52. By comparison, the embodiment of the LED reflector optic 24 of the present invention as depicted in FIG. 8 utilizes the majority of the high intensity central portion of the light intensity distribution typically emitted by the LED 52. A numerical comparison of the light utilizations depicted by FIGS. 9 and 11 shows that the area under the dotted line in FIG. 9 is about 45% greater than the area under the dotted line in FIG. 11. Thus, the embodiment of the LED reflector optic 24 depicted in FIG. 8 provides approximately a 45% increase in light utilization from a single LED 52, in comparison to the alternative arrangement depicted in FIG. 10.

Furthermore, the embodiment of the LED reflector optic 24 depicted in FIG. 8 provides the possibility of the reflector 28 having a reduced size relative to the embodiment of the alternative arrangement depicted in FIG. 10. For example, the reflector 28 depicted in FIG. 8 has a size which is reduced by about half in comparison to the embodiment of the reflector 28 depicted in FIG. 10.

The utilization of light by the embodiment of the LED reflector optic 24 depicted in FIG. 8 of the light emitted by the LED 52 provides an advantage of the present invention. However, the present invention nonetheless provides other advantages, and thus one embodiment of the LED reflector optic 24 comprises the LED 52 positioned such that the central light-emitting axis 56 is angled at the angle $\theta_A$ having a value of about 0°, as depicted in FIG. 10. In one embodiment, the about 0° has a tolerance of ±30°, i.e., from −30° to 30°. In another embodiment, the about 0° has a tolerance of ±10°, i.e., from −10° to 10°.

An exemplary illustration of another advantage provided by an aspect of the present invention is depicted in FIGS. 12-15. The projection of the cross-section 40 of the reflecting surface 32 along the linear extrusion axis 44 advantageously provides increased collimation of the reflected light.

Figure 12:
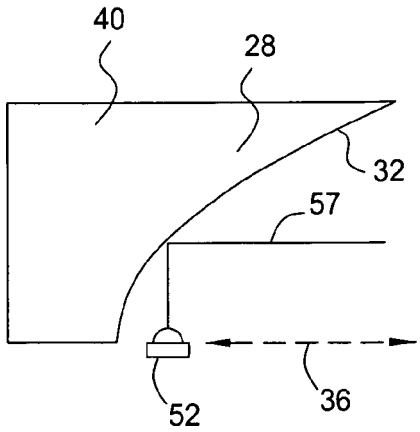
FIG. 12 depicts a partial side view of an embodiment of the LED reflector optic depicted in FIG. 2, showing mathematically simulated ray traces.

FIG. 12 depicts a partial side view of an embodiment of the LED reflector optic 24. In the embodiment of FIG. 12, the LED 52 is located at the focal distance of the reflecting surface 32 in a plane 47 (depicted in FIG. 16A). FIG. 12 also depicts mathematically simulated ray traces 57 showing the path of light traveling from the LED 52 to the reflecting surface 32 and outward from the reflector 28. Ray tracing is a technique that uses 3-D computer modeling and geometric optics to accurately determine the light path. FIG. 12 shows the ray traces 57 are parallel to the optical axis 36 in the depicted embodiment of the LED reflector optic 24.

Figure 13:
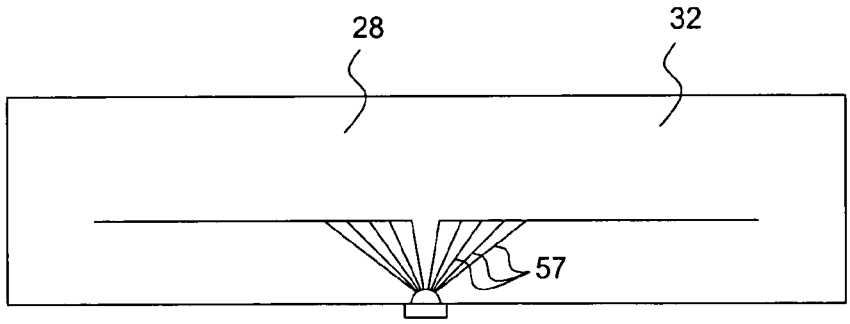
FIG. 13 depicts a partial front view of the embodiment of the LED reflector optic depicted in FIG. 12, showing the same ray traces shown in FIG. 12 from another view.

FIG. 13 depicts a partial frontal view of the embodiment of the LED reflector optic 24 depicted in FIG. 12, showing the same mathematically simulated ray traces 57 as FIG. 12, but from another view. Because the reflecting surface 32 of FIGS. 12 and 13 is a projection of the cross-section 40 along the linear extrusion axis 44, light traveling from the LED 52 to the reflecting surface results in well collimated light reflected parallel to the optical axis 36 of the reflecting surface 32.

Figure 14:
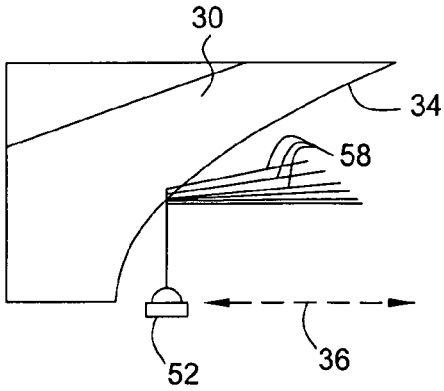
FIG. 14 depicts a partial side view of an embodiment of an alternative reflector having an alternative reflecting surface, showing mathematically simulated ray traces.

By comparison, FIG. 14 depicts a partial side view of an embodiment of an alternative reflector 30 having an alternative reflecting surface 34 which is an unsegmented reflecting surface 34. The alternative reflecting surface 34 has a cross-section that is projected along a curved trajectory 48 (as depicted in FIG. 17), not a linear axis. In the embodiment of FIG. 14, the LED 52 is located at the focal distance of the reflecting surface 32 in the plane 51 (depicted in FIG. 16B). FIG. 14 also depicts mathematically simulated ray traces 58 showing the path of light traveling from the LED 52, to the reflecting surface 32 and outward from the reflector 28.

Figure 15:
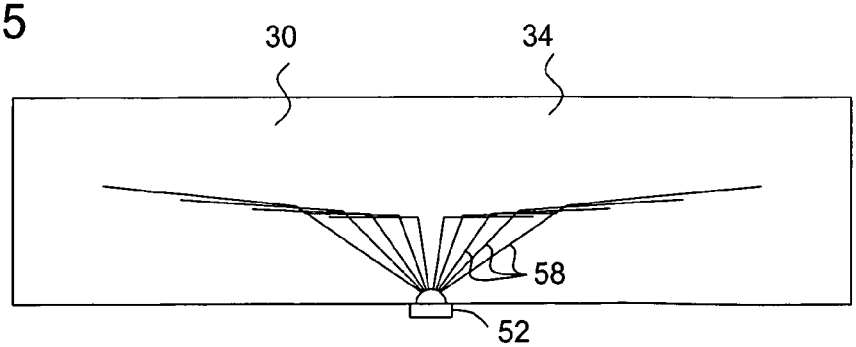
FIG. 15 depicts a partial front view of the embodiment of the alternative reflector having the alternative reflecting surface depicted in FIG. 14, showing the same ray traces shown in FIG. 14 from another view.

FIG. 15 depicts a partial front view of the embodiment of the alternative reflector 30 having the alternative reflecting surface 34 depicted in FIG. 14, and showing the same mathematically simulated ray traces 58 as FIG. 14, but from another view. FIGS. 14 and 15 shows that the light reflected by the alternative reflector 30 is not as well collimated as the light reflected by the reflector 28, as depicted in FIGS. 12 and 13. Light is reflected from the alternative reflecting surface 34 at angles vertically away from the optical axis 36.

Figure 16A:
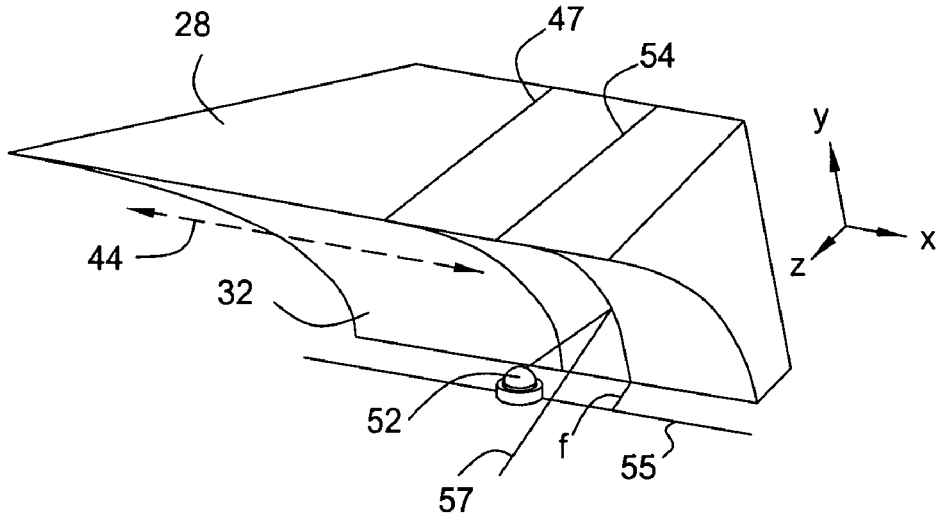
FIG. 16*a* depicts a perspective view of an embodiment of a segment, having the reflecting surface, of an embodiment of the LED reflector optic depicted in FIGS. 12 and 13.
Figure 16B:
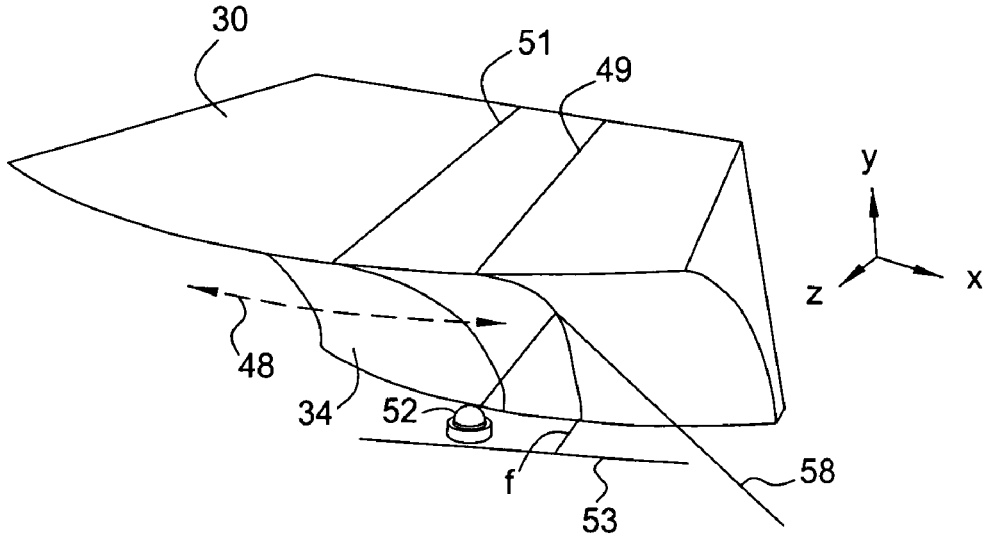
FIG. 16*b* depicts a partial perspective view of an embodiment the LED reflector optic having an embodiment of the alternative reflector comprising the alternative reflecting surface depicted in FIGS. 14 and 15.
Figure 17:
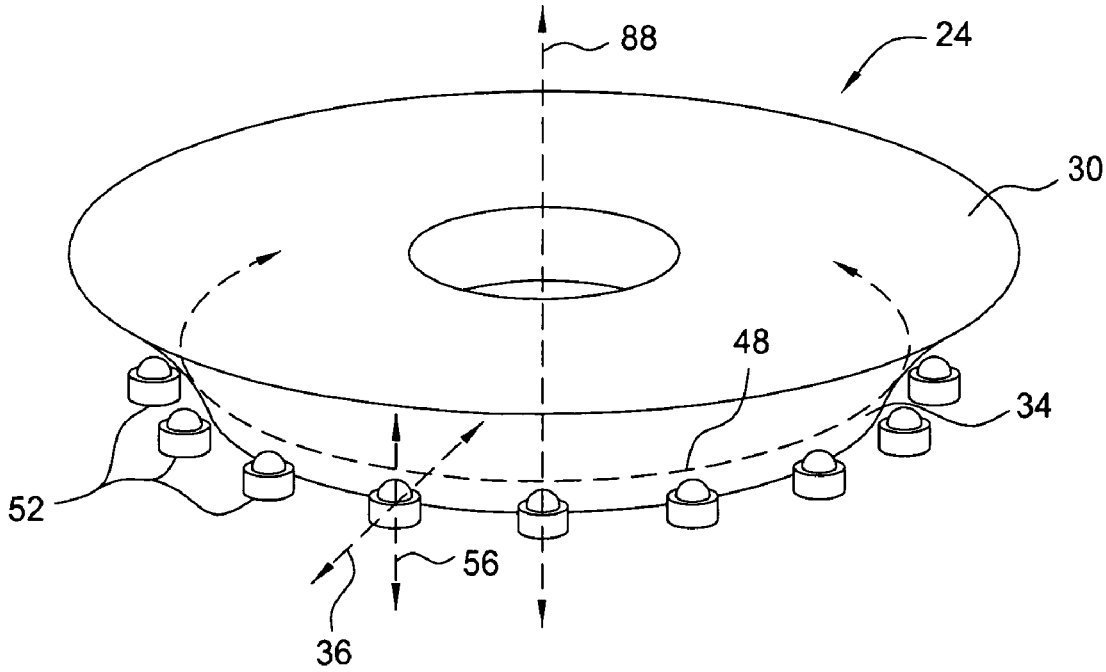
FIG. 17 depicts a perspective view of an embodiment of the LED reflector optic having an embodiment of the alternative reflector comprising the alternative reflecting surface.

FIG. 16A depicts a perspective view of an embodiment of a segment of the reflector 28 depicted in FIG. 12, and FIG. 16B a partial perspective view of an embodiment of the alternative reflector 30 depicted in FIG. 14. The increased collimation provided by the reflector 28, in comparison to the alternative reflector 30, can also be better understood in reference to FIGS. 16A and 16B. Generally speaking, a parabolic reflector, for example, receives light originating from its focal distance and reflects the light parallel to the optical axis of the reflector. If the reflector has the cross-section 40 projected along the linear extrusion axis 44, as in the embodiment of the reflector 28 depicted in FIG. 16A, then the parabolic system is lost only in the horizontal direction and is conserved in the vertical direction and the light will be collimated vertically. For example, considering light comprising vector components in the x, y and z directions depicted in FIG. 16A, line 55 demarks the focal length f for the vector component of light traveling in the y direction, and line 55 is common to the entire length of the reflector. Therefore the vector component of light emitted by LED 52 in the y direction strikes both plane 54 and plane 47 as arriving from the focal length.

By comparison, if the reflector is revolved, i.e. having the cross-section projected along the curved trajectory 48, as in the embodiment of the reflector 30 depicted in FIG. 16B, then the parabolic system is lost in both the horizontal and vertical directions. For example, FIG. 16B depicts a line 53 demarking the focal length f for the vector component of light traveling in the y direction, with respect to light arriving at plane 49, plane 49 being offset and angled horizontally from the plane 51. FIG. 16B shows that the LED 52 does not fall on the line 53 and thus does not emit a component of light in the y direction which strikes plane 49 as arriving from the focal length.

Thus, the embodiment of the reflector 28 having the projection of the cross-section 40 of the reflecting surface 32 along the linear extrusion axis 44 provides increased collimation of reflected light in comparison to the alternative reflector 30 having the alternative reflecting surface 34. However, the present invention nonetheless provides other advantages, and thus in one embodiment, as depicted in FIG. 17, the LED reflector optic 24 comprises the alternative reflector 30 having the alternative reflecting surface 34.

The LED reflector optic 24 and the beacon light 20 of the present invention provide a more efficient optical system. This more efficient optical system results in smaller and lighter devices with lower energy consumption and less light pollution. The more efficient optical system also enables greater use of solar power to power the LED reflector optic 24 and the beacon light 20.

In one embodiment, the reflecting surface 32 comprises at least one of: a metal or a reflective material. For example, in one embodiment the reflecting surface 32 comprises a reflectorized surface such as, for example, a surface comprising a layered polymer which reflects light.

Figure 18:
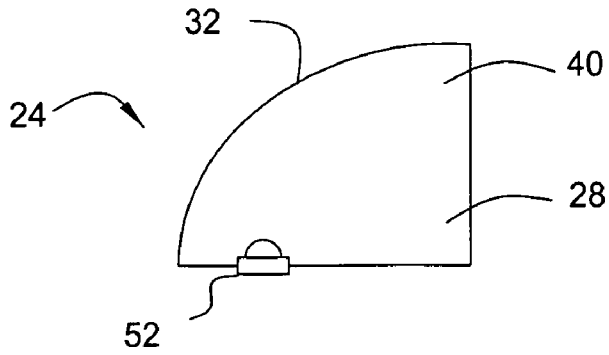
FIG. 18 depicts a partial sectional view of an embodiment of the LED reflector optic comprising at least one of: a glass, a plastic or a transparent material.

In another embodiment, depicted in FIG. 18, the reflector 28 comprises at least one of: glass, plastic or a transparent material. In the embodiment depicted in FIG. 18, the reflector 28 reflects light using total internal reflection.

Other embodiments are also provided in which the LED reflector optic 24 comprises at least one of: glass, plastic or a transparent material. In one embodiment, the LED reflector optic 24 has a light transmitting element 96 comprising the at least one of: glass, plastic or a transparent material. The LED reflector optic 24 having the light transmitting element 96 also comprises at least one LED 52 positioned relative to the light transmitting element 96. In one embodiment, the at least one LED 52 comprises a plurality of LEDs 52.

The light-transmitting element 96 has a light-entering surface 100, a light-reflecting surface 101, and a light-exiting surface 102. The light-entering surface 100 receives light from the associated plurality of LEDs 52. The light-reflecting surface 101 reflects light traveling through the light-transmitting element 96 by an internal reflection mechanism. Namely, the light-reflecting surface 101 reflects light arriving from inside the light-transmitting element 96 at the light-reflecting surface 101 back into the light-transmitting element 96. The light-exiting surface 102 emits light from the light-transmitting element 96 which is received by the light-transmitting element 96 at the light-entering surface 100 and travels through the light-transmitting element 96. At least a portion of the light emitted from the light-exiting surface 102 is internally reflected by the light-reflecting surface 101.

Figure 19A:
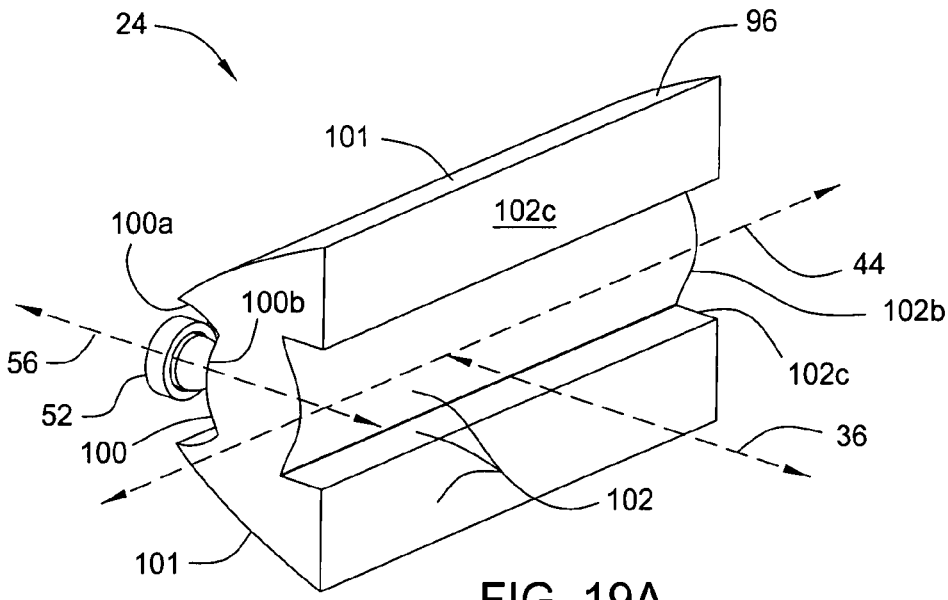
FIGS. 19*a-b* depict perspective views of an embodiment of the LED reflector optic comprising an embodiment of a light-transmitting element.
Figure 19B:
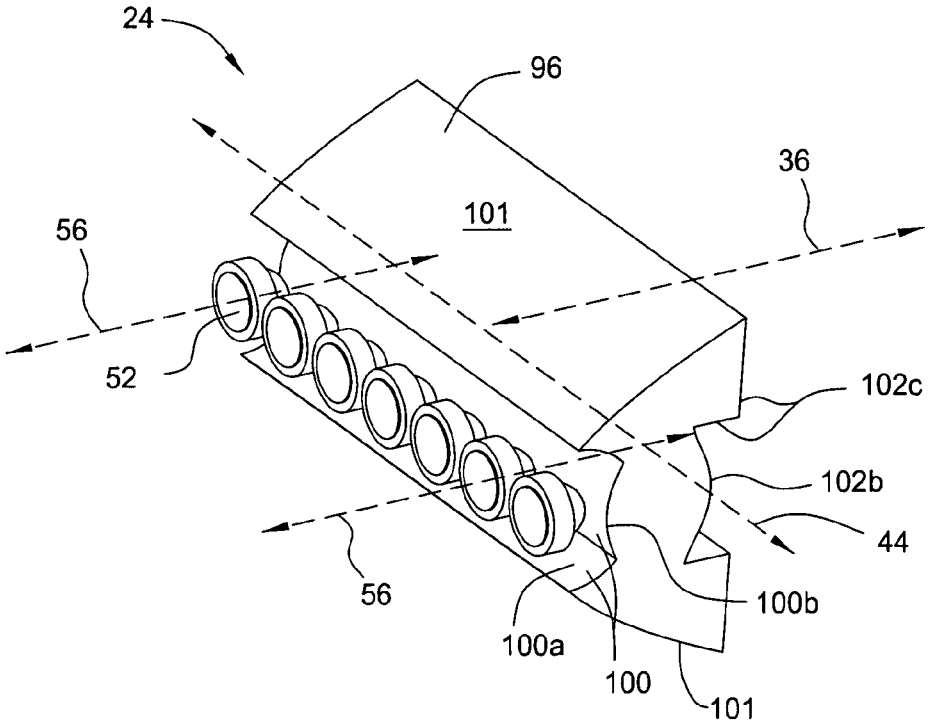

FIGS. 19*a-b* depict one embodiment of the LED reflector optic 24 comprising an embodiment of the light-transmitting element 96 and the plurality of LEDs 52. In a similar manner to the reflector 28, the light-transmitting element 96 is also associated with the optical axis 36, the extrusion axis 44 and a plurality of the central light emitting axes 56.

The light-transmitting element 96 emits light from the light-exiting surface 102 about the optical axis 36 associated with the light-transmitting element 96. In the embodiment depicted in FIGS. 19*a-b*, the central light emitting axis 56 of each of the plurality of LEDs 52 is approximately parallel to the optical axis 36 associated with the light-transmitting element 96. That is, in the embodiment depicted in FIGS. 19*a-b*, the central light emitting axis 56 of each of the plurality of LEDs 52 is angled relative to the optical axis 36 at an angle of about 0°. In one embodiment, the about 0° has a tolerance of ±10°.

The light-transmitting element 96 has a constant cross-section 98 which is linearly projected for a predetermined distance along the extrusion axis 44. In the embodiment depicted in FIGS. 19*a-b*, the extrusion axis 44 is approximately perpendicular to the optical axis 36. That is, the extrusion axis 44 is angled relative to the optical axis 36 at an angle of about 90°. In one embodiment, the about 90° has a tolerance of ±10°.

Aspects of the embodiment of the light-transmitting element 96 depicted in FIGS. 19*a-b* can be understood in part by considering that the light-reflecting surfaces 101 of the light-transmitting element 96 depicted in FIG. 19*a-b* conformally matches portions of the embodiments of the reflecting surface 32 depicted in FIGS. 8 and 10. Also, the orientation of the central light emitting axis 56 of the LEDs 52 relative to the optical axis 36 of the LED reflector optic 24 depicted in FIGS. 19*a-b* is the same as the orientation of the central light emitting axis 56 relative to the optical axis 36 depicted in FIG. 10.

The light-entering surface 100 and the light-exiting surface 102 of the light-transmitting element 96 have shapes selected to provide predetermined optical characteristics such as concentrating and collimating of the light emitted by the light-transmitting element 96. Optionally, the light-entering surface 100 comprises a plurality of surfaces (e.g., 100*a*, 100*b*, and 100*c*) which collectively receive the light from the plurality of LEDs 52. Similarly, the light-exiting surface 102 optionally comprises a plurality of surfaces (e.g., 102*b* and 102*c*) which collectively emit light from the light-transmitting element 96.

FIGS. 20*a-d* depict embodiments of the constant cross-section 98 of the light-transmitting element 96 which is linearly projected along the extrusion axis 44. FIGS. 20*a-d* also depict ray traces 99 showing paths of light traveling from the light-entering surface 100 to the light-exiting surface 102.

Figure 20A:
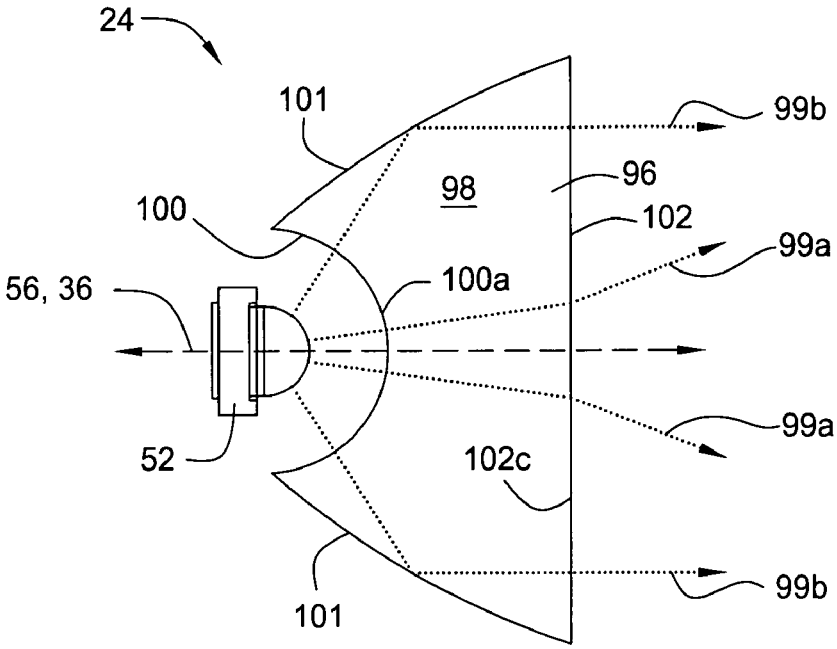
FIGS. 20*a-d* depict cross-sectional views of embodiments of the light-transmitting element.

FIG. 20*a* depicts an embodiment of the light-transmitting element 96 having a light-entering surface 100 comprising a concave curved surface 100*a*, and a light-exiting surface 102 comprising a planar surface 102*c*. In the embodiment depicted in FIG. 20*a*, a first portion 99*a* of light travels from the concave light-entering surface 100*a* to the planar light-exiting surface 102*c* without being reflected by the light-reflecting surface 104, and a second portion 99*b* of light travels from the concave light-entering surface 100*a* to the planar light-exiting surface 102*c* and is reflected along the way by the light-reflecting surface 101.

Figure 20B:
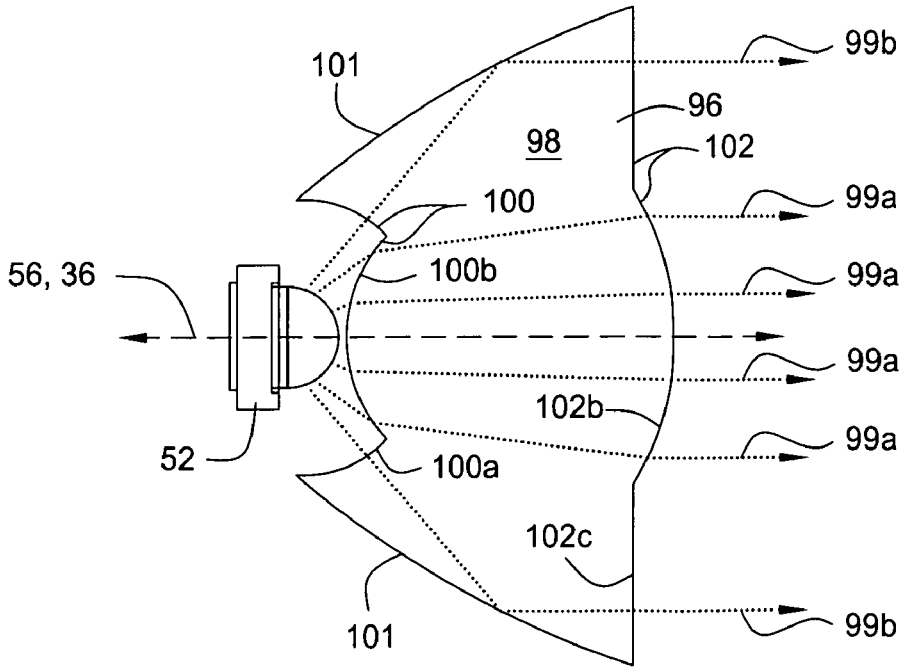

FIG. 20*b* depicts an embodiment of the light-transmitting element 96 having a light-entering surface 100 comprising a convex curved surface 100*b* and a plurality of concave curved surfaces 100*a*, and a light-exiting surface 102 comprising a convex curved surface 102*b* and a plurality of planar surfaces 102*c*. In the embodiment depicted in FIG. 20*b*, a first portion 99*a* of light travels from the convex light-entering surface 100*b* to the convex light-exiting surface 102*b* without being reflected by the light-reflecting surface 101, and a second portion 99*b* of light travels from the concave light-entering surface 100*a* to the planar light-exiting surfaces 102*c* and is reflected along the way by the light-reflecting surface 101.

Figure 20C:
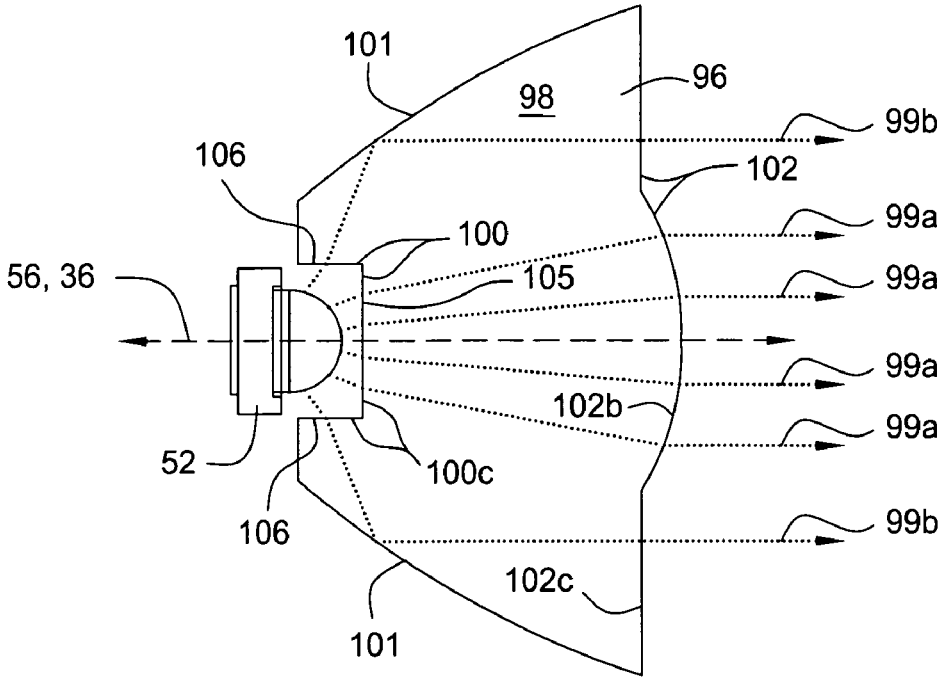

FIG. 20*c* depicts an embodiment of the light-transmitting element 96 having a light-entering surface 100 comprising a plurality of planar surfaces 100*c*, and a light-exiting surface 102 comprising a convex curved surface 102*b* and a plurality of planar surfaces 102*c*. In the embodiment depicted in FIG. 20*c*, a first portion of light 99*a* travels from a first subset 105 of the plurality of planar light-entering surfaces 100*c* to the convex light-exiting surfaces 102*b* without being reflected by the light-reflecting surface 101, and a second portion 99*b* of light that travels from a second subset 106 of the plurality of planar light-entering surfaces 100*c* to the planar light-exiting surfaces 102*c* and is reflected along the way by the light-reflecting surface 101.

Figure 20D:
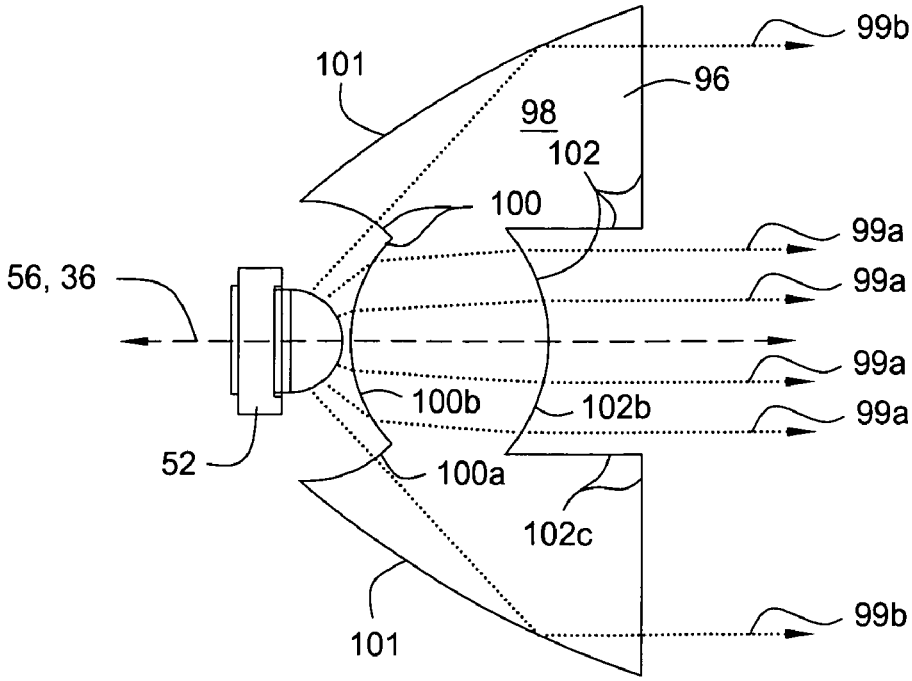

FIG. 20*d* depicts an embodiment of the light-transmitting element 96 having a light-entering surface 100 comprising a convex curved surface 100*b* and a plurality of concave curved surfaces 100*a*, and a light-exiting surface 102 comprising a convex curved surface 102*b* and a plurality of planar surfaces 102*c*. In the embodiment depicted in FIG. 20*d*, a first portion 99*a* of light travels from the convex light-entering surface 100*b* to the convex light-exiting surface 102*b* without being reflected by the light-reflecting surface 101, and a second portion 99*b* of light travels from the concave light-entering surface 100*a* to the planar light-exiting surfaces 102*c* and is reflected along the way by the light-reflecting surface 101.

Although FIGS. 20*a-d* each depict the light-reflecting surface 101 as having substantially similar shapes, in one embodiment the shape of the light-reflecting surface 101 is adjusted to provide light reflecting characteristics most appropriate for the particular shapes of the light-entering surface 100 and light-exiting surface 102.

In some embodiments, at least one of the light-entering surface 100 or the light-exiting surface 102 refract light traveling through these surfaces. In other embodiments, however, the light-entering surface 100 and the light-exiting surface 102 provide little or no refraction of the light entering or exiting. For example, the embodiment of the light-entering surface 100*b* depicted in FIG. 20*b* refracts the entering light. Similarly, the embodiments of the light-entering surfaces 100*c* depicted in FIG. 20*c*, as well as the embodiment of the light-entering surface 100*b* depicted in FIG. 20*d*, also refract the entering light. In another example, the embodiment of the light-entering surface 100*a* depicted in FIG. 20*a* provides little or no refraction of the entering light. Similarly, the embodiments of the light-entering surfaces 100*a* depicted in FIG. 20*b* also provide little or no refraction of the entering light.

In one embodiment of the LED reflector optic 24, the central light-emitting axis 56 of the at least one LED 52 is angled relative to the optical axis 36 associated with the light-transmitting element 96 at angles which do not fall under the range of about 0° with a tolerance of ±10°. In such embodiments, the shapes of the light-entering surface 100, light-reflecting surface 101 and light-exiting surface 102 can be adjusted to provide emitted light from the light-transmitting element 96 about the optical axis 36 and having desirable optical characteristics.

Figure 21:
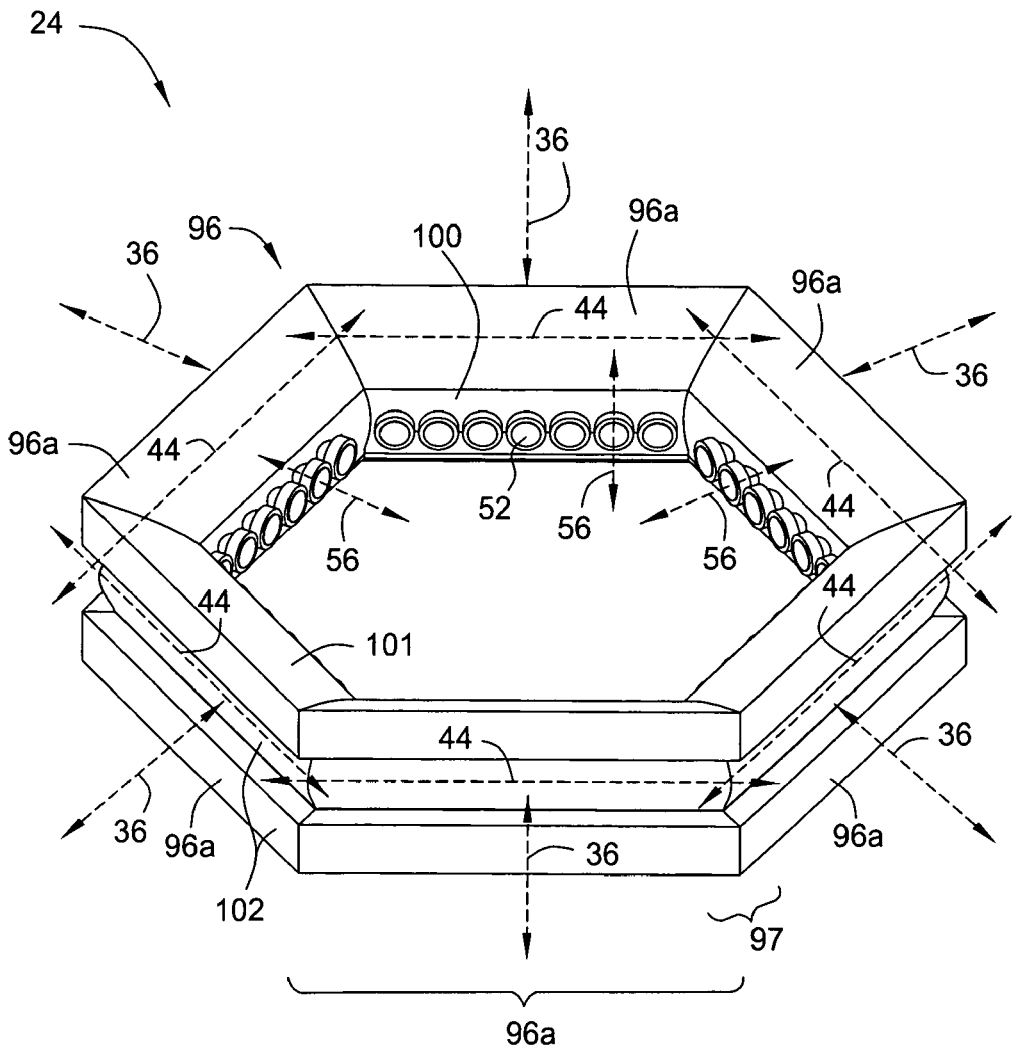
FIG. 21 depicts a perspective view of an embodiment of the LED reflector optic comprising an embodiment of the light-transmitting element which is a segmented light-transmitting element.

In one embodiment, the light-transmitting element 96 is a segmented light transmitting element 96 having a plurality of segments 96*a*. FIG. 21 depicts an embodiment of the LED reflector optic 24 having an embodiment of the segmented light-transmitting element 96. The segments 96*a* of the segmented light-transmitting element 96 can be arranged relative to each other in the same way that the plurality of reflecting surfaces 32 of the segmented reflector 28 are arranged relative to each other, e.g., as depicted in FIG. 2. The segmented light-transmitting element 96 can be incorporated into the beacon light 20 in the same manner in which the segmented reflector 28 is incorporated into the beacon light 20, e.g., as depicted in FIG. 1. The segmented light-transmitting element 96 comprises a plurality of light-entering surfaces 100, a plurality of light-reflecting surfaces 101, and a plurality of light-exiting surfaces 102.

Each segment 96*a* of the segmented light-transmitting element 96 has an associated optical axis 36 and extrusion axis 44. In embodiments of the LED reflector optic 24 comprising the segmented light-transmitting element 96, each segment 96*a* is associated with at least one LED 52 having a central light emitting axis 56. In one embodiment, the associated at least one LED 52 comprises a plurality of LEDs 52. Each segment 96*a* of the segmented light-transmitting element 96 emits light from that segment's light-exiting surface 102 about the optical axis 36 associated with that segment 96*a*. In the embodiment of the LED reflector optic 24 depicted in FIG. 21, the central light emitting axes 56 of each of the plurality of LEDs 52 associated with a particular segment 96*a* are approximately parallel to the optical axis 36 associated with that particular segment 96*a* of the segmented light-transmitting element 96. That is, the central light emitting axis 56 of each of the plurality of LEDs 52 associated with a particular segment 96*a* is angled relative to the associated optical axis 36 of that segment 96*a* at an angle of about 0°. In one embodiment, the about 0° has a tolerance of ±10°. Each segment 96*a* of the segmented light-transmitting element 96 has a constant cross-section 98 which is linearly projected for a predetermined distance along the associated extrusion axis 44. In one embodiment, each segment 96*a* comprises a portion 97 which connects to another segment 96*a* and which has a non-constant cross-section to provide for a transition between segments 96*a*. In the embodiment depicted in FIG. 21, the extrusion axis 44 associated with each segment 96*a* is approximately perpendicular to the optical axis 36 associated with that segment 96*a*. That is, the extrusion axis 44 of each segment 96*a* is angled relative to the optical axis 36 associated with that segment at an angle of about 90°. In one embodiment, the about 90° has a tolerance of ±10°.

The embodiment of the segmented light-transmitting element 96 depicted in FIG. 21 shares some of the advantageous characteristics of the embodiment of the segmented reflector 28 shown in FIG. 2.

The plurality of segments 96*a* of the segmented light-transmitting element 96 are arranged so that each of the associated extrusion axes 44 is angled relative to the extrusion axis 44 of another segment 96*a*. In one embodiment, extrusion axes 44 associated with adjacent segments 96*a* are angled relative to each other at non-zero angles. In one embodiment, a top view cross-section of the segmented light-transmitting element 96 comprises a perimeter which is a polygon. For example, in the embodiment depicted in FIG. 21, a top view cross-section of the segmented light-transmitting element comprises a hexagon and the extrusion axes of adjacent segments are angled relative to each other at about 60°.

The collective light-exiting surface 102 of each segment 96*a* emits light which is horizontally and vertically symmetric about the optical axis 36 associated with that segment 96*a*. In one embodiment, each horizontal angular distribution of emitted light associated with a specific segment 96*a* of the segmented light-transmitting element 96 overlaps the horizontal angular distribution of emitted light associated with an adjacent segment 96*a*. In one embodiment, the light emitted from each segment 96*a* overlaps the light emitted from adjacent segments 96*a* to form an overall emission of light from the light-transmitting element 96 which has a more uniform intensity profile versus horizontal angular displacement than the individual intensity profiles of light emitted from the individual segments 96*a*.

Although FIG. 21 depicts a polygon embodiment of the segmented light-transmitting 96 element having six segments 96*a*, in another polygon embodiment the segmented light-transmitting element 96 has at least three segments 96*a*.

The segmented light-transmitting element 96 advantageously provides increased collimation of emitted light relative to an alternative light-transmitting element which has a cross-section projected along a curved trajectory instead of along the linear extrusion axis 44. This increased collimation provided by the segmented light-transmitting element 96 is similar to the increased collimation provided by the segmented reflector 28 in comparison to the alternative reflecting surface 34 having a cross-section that is projected along the curved trajectory 48, as discussed in regards to FIGS. 12-15.

The light-reflecting surface 104 may comprise at least one of: a conic or a substantially conic shape. In one embodiment, the conic shape comprises at least one of: a hyperbola, a parabola, an ellipse, a circle, or a modified conic shape.

In one embodiment, the plurality of LEDs 52 associated with the light-transmitting element 96 or each segment 96*a* of the segmented light transmitting element 96 are arranged along a line parallel to the associated extrusion axis 44. In one embodiment, the plurality of associated LEDs 52 are staggered about a line. In one embodiment, the plurality of associated LEDs 52 are staggered within ±0.1 inch of a line. In one embodiment, the plurality of LEDs 52 are positioned at the focal distance of the light-reflecting surface 104.

The intensity distribution of light emitted from the LED reflector optic 24 can be adjusted by modifying the specific shape of the reflecting surface 32 or the light-reflecting surface 101. In one embodiment, the shape of the cross-section 40 of the reflecting surface 32 or the shape of the light-reflecting surface 101 is defined by the following equation:

$$z = \frac{cy^2}{1 + \sqrt{1 - (1 + k)c^2y^2}} + F(y), \tag{1}$$

where z is a coordinate along an axis parallel to the optical axis 36, y is a coordinate on an axis perpendicular to both the optical axis and the extrusion axis, k is a conic constant, c is a curvature, and F(y) is a variable function. FIG. 16A depicts the relationship of the z and y coordinates, as well as an x coordinate along an axis parallel to the extrusion axis 44, with respect to the reflecting surface 32.

In one embodiment, F(y) is equal to zero, and equation (1) provides a conic cross-section. For example, ($k<-1$) provides a hyperbola, ($k=-1$) provides a parabola, ($-1<k<0$) provides an ellipse, ($k=0$) provides a sphere, and ($k>0$) provides an oblate sphere, which are all forms of conics. Modifying k and c modifies the shape of the reflecting surface 32 or the light-reflecting surface 101, and thus also modifies the shape of the light intensity distribution reflected by the reflecting surface 32 or the light-reflecting surface 101. The reflected beam may thereby be made more narrow or broad as desired.

In one embodiment, F(y) is not equal to zero, and equation (1) provides a cross-sectional shape which is modified relative to a conic shape by an additional mathematical term or terms. For example, F(y) can be chosen to modify a conic shape to alter the reflected light intensity distribution in some desirable manner. Also, in one embodiment, F(y) can be used to provide a cross-sectional shape which approximates other shapes, or accommodates a tolerance factor in regards to a conic shape. For example, F(y) may be set to provide cross-sectional shape having a predetermined tolerance relative to a conic cross-section. In one embodiment, F(y) is set to provide values of z which are within 10% of the values provided by the same equation but with F(y) equal to zero.

In one embodiment, the specific cross-sectional conic shape of the alternative reflecting surface 34 is defined by the following set of equations:

$$z = \frac{cr^2}{1+\sqrt{1-(1+k)c^2r^2}}, \text{ and} \quad (2$$

$$r^2 = x^2 + y^2; \quad (3)$$

where x, y, z, c and k are defined as above in regards to equation (1). FIG. 16B depicts the relationship of the x, y and z coordinates with respect to the alternative reflecting surface 34.

In another embodiment, the cross-sectional shape of the alternative reflecting surface 34 has a shape which comprises the basic conic shape modified by using additional mathematical terms. For example, in one embodiment, the cross-sectional shape of the alternative reflecting surface 34 comprises a polynomial asphere defined by the following set of equations:

$$z = \frac{cr^2}{1+\sqrt{1-(1+k)c^2r^2}} + \sum_{n=2}^{10} C_{2n}r^{2n} \quad (4)$$

$$r^2 = x^2 + y^2; \quad (5)$$

wherein x, y, z, k and c are as defined above, and C is a constant.

In another embodiment, the shape of the cross-section 40 of the reflecting surface 32 or the light-reflecting surface 101 is defined by fitting a curve, such as a spline fit, to a set of points. In one embodiment, the spline fit is used to approximate the conic or substantially conic cross-sectional shape of one embodiment of the cross-section 40.

Figure 22:
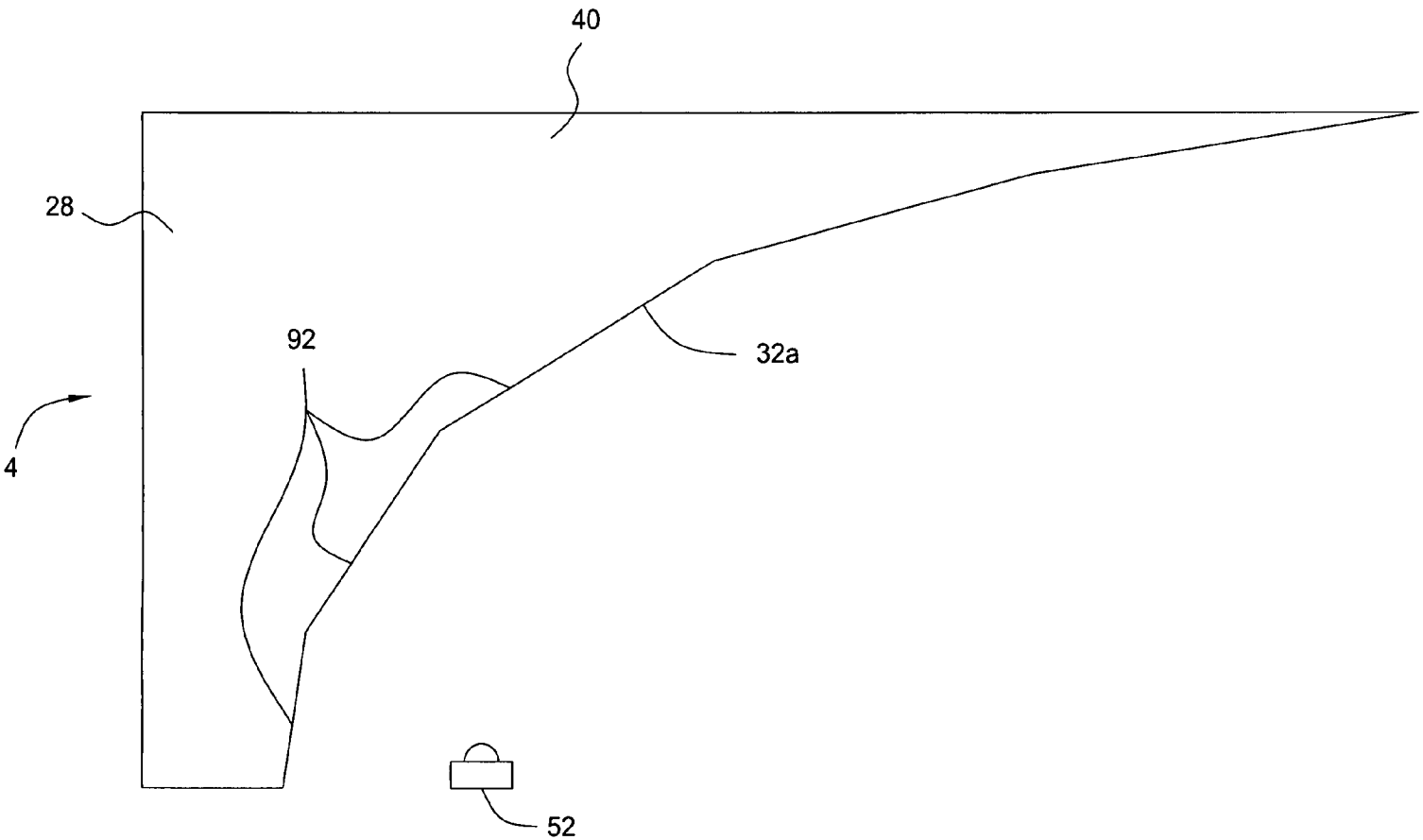
FIG. 22 depicts a partial sectional side view of an embodiment of the LED reflector optic having a faceted reflecting surface.

In another embodiment, as depicted in FIG. 22, the reflector comprises a reflecting surface which is a faceted surface 32*a* which has a shape which approximates a conic shape. The faceted surface 32*a* comprises a plurality of individual planar facets 92. Collectively, the plurality of individual planar facets 92 approximate a conic shape, with the approximation becoming more accurate as the individual planar facets 92 are made smaller.

Figure 23:
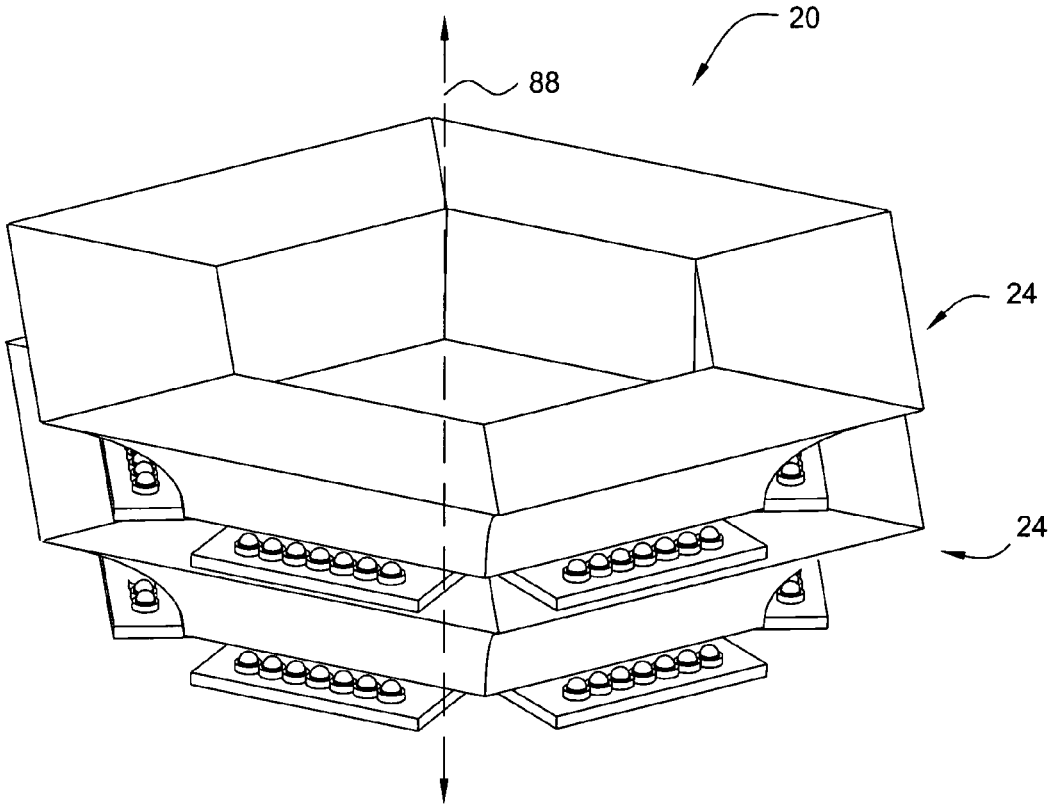
FIG. 23 depicts a partial perspective view of an embodiment of the beacon light having a plurality of the LED reflector optics.

In one embodiment, the beacon light 20 comprises a plurality of LED reflector optics 24. For example, FIG. 23 depicts a partial perspective view of an embodiment of the beacon light 20 which comprises a plurality of LED reflector optics 24 stacked on top of each other. Although FIG. 23 shows an embodiment of a beacon light comprising a plurality of the LED reflector optics 24 having the reflector 28, in one embodiment, the beacon light may comprise a plurality of the LED reflector optics 24 having the light-transmitting element 96.

A method of using the LED reflector optic 24 or the beacon light 20 comprises arranging a plurality of the reflecting surfaces 32 relative to each other, each of the plurality of reflecting surfaces 32 comprising the linearly projected cross-section 40. The method also comprises positioning at least one LED 52 relative to at least one of the plurality of reflecting surfaces 32, wherein the positioning step angles the central light-emitting axis 56 of the at least one LED 52 relative to at least one optical axis 36 associated with the plurality of reflecting surfaces 32 at about 90°. The method also comprises transmitting light from the at least one LED 52 to the at least one of the plurality of reflecting surfaces 32. In one embodiment of the method, the about 90° has a tolerance of ±30°.

In one embodiment of the method, the at least one LED 52 comprises a plurality of LEDs 52, the at least one optical axis 36 comprises a plurality of optical axes 36, and the positioning step comprises positioning each of the plurality of LEDs 52 relative to a respective one of the plurality of optical axes 36 at about 90°. In one embodiment of the method, each reflecting surface 32 comprises a cross-section 40 projected along a linear extrusion axis 44, and the arranging step comprises arranging the plurality of reflecting surfaces 32 relative to each other so that a plurality of the linear extrusion axes 44 are angled relative to each other.

In one embodiment, the reflector optic 24 comprises a plurality of reflecting means 32 for reflecting light in the direction of at least one optical axis 36, each reflecting means 32 comprising a means for receiving light along a linearly projected cross-section 40. The optic also comprises at least one light emitting means 52 for emitting a hemisphere of light, the at least one light emitting means 52 positioned such that a central light-emitting axis 56 of the at least one light emitting means 52 is angled relative to the at least one optical axis 36 at about 90°. In one embodiment of the optic 24, the about 90° has a tolerance of ±30°.

The present invention has been generally described within the context of the LED reflector optic 24 and the beacon light 20. However, it will be appreciated by those skilled in the art that while the invention has specific utility within the context of the LED reflector optic 24 and the beacon light 20, the invention has broad applicability to any light system.

While the foregoing is directed to embodiments of the present invention, other and further embodiments of the invention may be devised without departing from the basic scope thereof, and the scope thereof is determined by the claims that follow. Various embodiments presented herein, or portions thereof, may be combined to create further embodiments. Furthermore, terms such as top, side, bottom, front, back, and the like are relative or positional terms and are used with respect to the exemplary embodiments illustrated in the figures, and as such these terms may be interchangeable.

The invention claimed is:

1. A light-emitting diode (LED) optic, comprising:

a light-transmitting element having a plurality of segments, each segment having an optical axis and a linear extrusion axis and comprising a cross-section that is projected along a portion of the linear extrusion axis; and for each segment, at least one LED positioned such that a central light-emitting axis of the at least one LED is angled at about 0° relative to the optical axis associated with that segment, wherein a light emitted by the at least one LED has a beam spread of approximately 3 degrees, wherein the beam spread is approximately 1.5 degrees on either side of a plane containing the optical axis, wherein a plurality of the linear extrusion axes associated with the plurality of segments is angled relative to each other such that light from said plurality of segments is emitted outward over a 360° angular distribution from a central axis of the LED optic.

2. The LED optic of claim 1, wherein each segment of the light-transmitting element comprises a light-entering surface, a light-exiting surface and a light-reflecting surface.

3. The LED optic of claim 2, wherein for each segment of the light-transmitting element the at least one LED comprises a plurality of LEDs that is arranged so that at least a portion of light received by the light-entering surface from the plurality of LEDs is reflected by the light-reflecting surface by total internal reflection within that segment of the light transmitting element.

4. The LED optic of claim 2, wherein for each segment of the light-transmitting element the at least one LED comprises a plurality of LEDs that is arranged so that at least a portion of light received by the light-entering surface from the LEDs arrives at the light-exiting surface without being reflected by the light-reflecting surface.

5. The LED optic of claim 2, wherein the light-reflecting surface comprises at least one of: a conic shape or a substantially conic shape.

6. The LED optic of claim 2, wherein at least one light-reflecting surface satisfies an equation:

$$z = \frac{cy^2}{1 + \sqrt{1 - (1 + k)c^2y^2}} + F(y),$$

where z is a coordinate along an axis parallel to the optical axis, y is a coordinate on an axis perpendicular to both the optical axis and an extrusion axis, k is a conic constant, c is a curvature, and F(y) is a variable function, such that a zero value for F(y) produces a conic cross-sectional shape for the at least one light-reflecting surface and a non-zero value for F(y) produces a modified conic cross-sectional shape for the at least one light-reflecting surface.

7. The LED optic of claim 1, wherein the light-transmitting element comprises at least one of: a glass material, a plastic material or a transparent material.

8. The LED optic of claim 1, wherein the about 0° has a tolerance of ±10°.

9. The LED optic of claim 1, wherein the beam spread is defined as an angle vertically perpendicular to the optical axis of a respective segment of the light-transmitting element over which an intensity of the light emitted is greater than 50 percent of a peak intensity of the light emitted.

10. A method for transmitting light, comprising:

arranging a plurality of segments of a light-transmitting element relative to each other, each segment associated with an optical axis and a linear extrusion axis and comprising a cross-section that is projected along a portion of the linear extrusion axis;

for each segment, positioning at least one light-emitting diode (LED) such that a central light-emitting axis of the at least one LED is angled at about 0° relative to the optical axis associated with that segment; and transmitting light from the at least one LED, wherein the light transmitted by the at least one LED has a beam spread of approximately 3 degrees, wherein the beam spread is approximately 1.5 degrees on either side of a plane containing the optical axis, wherein a plurality of the linear extrusion axes associated with the plurality of segments are angled relative to each other such that light from said plurality of segments is transmitted outward over a 360° angular distribution from a central axis.

11. The method of claim 10, comprising providing a light-entering surface, a light-exiting surface and a light-reflecting surface of each segment of the light-transmitting element.

12. The method of claim 11, wherein for each segment the at least one LED comprises a plurality of LEDs, and the method comprises arranging the plurality of LEDs for each segment of the light-transmitting element so that at least a portion of light received by the light-entering surface from the plurality of LEDs is reflected by the light-reflecting surface by total internal reflection within that segment of the light transmitting element.

13. The method of claim 11, wherein for each segment the at least one LED comprises a plurality of LEDs, and the method comprises arranging the plurality of LEDs for each segment of the light-transmitting element so that at least a portion of light received by the light-entering surface from the plurality of LEDs arrives at the light-exiting surface without being reflected by the light-reflecting surface.

14. The method of claim 11, wherein the light-reflecting surface comprises at least one of: a conic shape or a substantially conic shape.

15. The method of claim 10, wherein the light-transmitting element comprises at least one of: a glass material, a plastic material or a transparent material.

16. The method of claim 10, wherein the about 0° has a tolerance of ±10°.

17. The method of claim 10, wherein the beam spread is defined as an angle vertically perpendicular to the optical axis of a respective segment of the light-transmitting element over which an intensity of the light is greater than 50 percent of a peak intensity of the light.

18. A reflector optic, comprising:

a plurality of light-transmitting means, each light-transmitting means being associated with an optical axis and a linear extrusion axis and comprising a means for transmitting light through a cross-section projected along a portion of the linear extrusion axis; and for each light-transmitting means, at least one light source means positioned such that a central light-emitting axis of the at least one light source means is angled at about 0° relative to the optical axis associated with that light-transmitting means, wherein a light emitted by the at least one light source means has a beam spread of approximately 3 degrees, wherein the beam spread is approximately 1.5 degrees on either side of a plane containing the optical axis, wherein a plurality of the linear extrusion axes associated with the plurality of light-transmitting means are angled relative to each other such that light from said plurality of light-transmitting means is emitted outward over a 360° angular distribution from a central axis of the reflector optic.

19. The reflector optic of claim 18, wherein the about 0° has a tolerance of ±10°.

20. The reflector optic of claim 18, wherein each light-transmitting means comprises a light-entering means, a light-reflecting means and a light-exiting means.

21. The reflector optic of claim 18, wherein the beam spread is defined as an angle vertically perpendicular to the optical axis of a respective one of the plurality of light-transmitting means over which an intensity of the light emitted is greater than 50 percent of a peak intensity of the light emitted.

* * * * *